US006868768B1

(12) United States Patent
Gieseke et al.

(10) Patent No.: US 6,868,768 B1
(45) Date of Patent: Mar. 22, 2005

(54) SURF ZONE MINE CLEARANCE AND ASSAULT SYSTEM

(75) Inventors: Thomas J. Gieseke, Newport, RI (US); Kyrill V. Korolenko, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/679,677

(22) Filed: Oct. 6, 2003

(51) Int. Cl.[7] ..... B63G 7/02
(52) U.S. Cl. ..... 89/1.13; 102/402
(58) Field of Search ..... 89/1.13; 102/402, 102/403

(56) References Cited

U.S. PATENT DOCUMENTS 2,938,434 A * 5/1960 Myron ..... 89/1.815
4,903,246 A 2/1990 Jarman
4,975,888 A * 12/1990 Kern ..... 367/96
5,267,220 A * 11/1993 Burt ..... 367/131
5,448,936 A * 9/1995 Turner ..... 89/1.13
5,831,724 A * 11/1998 Cordes ..... 356/141.1
5,844,159 A 12/1998 Posseme et al.
5,988,038 A * 11/1999 Feintuch ..... 89/1.13
6,305,263 B1 10/2001 Wallin

FOREIGN PATENT DOCUMENTS

EP 305 556 A1 * 3/1989 ..... 89/1.13
FR 2 677 133 * 12/1992 ..... 89/1.13

* cited by examiner

*Primary Examiner*—Stephen M. Johnson
(74) *Attorney, Agent, or Firm*—James M. Kasischke; Michael P. Stanley; James-Paul A. Nasser

(57) ABSTRACT

A system for clearing mines and other obstacles is provided. The system mountable to a vehicle which can operate in water and on land, includes a sonar targeting system and an underwater gun system. The underwater gun system is directed by readings from the sonar targeting system and fires underwater munitions to destroy detected mines and obstacles. The pod containing the sonar targeting system and the pod containing the underwater gun system are movable to target in multiple directions with each of the pods deployed at an end of a respective deployment arm.

10 Claims, 1 Drawing Sheet

SURF ZONE MINE CLEARANCE AND ASSAULT SYSTEM

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates to a system attachable to a vehicle for clearing mines and other obstacles.

(2) Description of the Prior Art

Some military operations require a system to clear mines and obstacles in shallow waters, a surf zone, and a craft landing zone. In addition, a requirement exists for mine hunting and clearance in deep waters (over 40 feet in depth).

A number of mine clearing systems are known in the prior art. These include the systems disclosed in Turner (U.S. Pat. No. 5,448,936); Jarman (U.S. Pat. No. 4,903,246); and Posseme et al. (U.S. Pat. No. 5,844,159). These systems and other available mine clearing systems have not fully met the needs of the military services.

Also known in the prior art are systems for protecting marine vessels from torpedo attack. One such system is disclosed in Wallin (U.S. Pat. No. 6,305,263). Still further, systems have been developed for protecting vessels against covert swimmers. One such system is disclosed in Burt (U.S. Pat. No. 5,267,220).

A replacement for existing mine clearing systems, which will operate in very shallow waters through the beach zone, is optimally maneuverable from the ship to the objective. In addition, the replacement for existing mine clearing systems optimally will not place personnel in the line of fire, will not require carrier battle group support, will not require allocation of lift capabilities, and will operate from over-the-horizon.

SUMMARY OF THE INVENTION

Accordingly, it is a general purpose and primary object of the present invention to provide a system attachable to a vehicle which adequately clears mines in a surf-zone and varying water-depth.

To attain the object described, there is provided a system attachable to a vehicle for clearing mines and other unwanted obstacles. The system is attachable to a vehicle which operates in the surf zone of a beach as well as in deeper waters with the system including means for detecting mines and other obstacles, and means for destroying the mines and the other obstacles.

In a preferred embodiment, the detecting means comprises a sonar targeting system mounted within a pod which can be focused in multiple directions and the destroying means comprises an underwater gun system also mounted within a pod which can target in multiple directions. The underwater gun system preferably fires underwater munitions to destroy the mines and/or other obstacles.

Other details of the surf zone mine clearance and assault system of the present invention, as well as other objects and advantages attendant thereto, are set forth in the following detailed description and the accompanying drawings wherein like reference numerals refer to like elements. It will be understood that the particular devices embodying the invention are shown by way of illustration only and not as limitations of the invention. The principles and features of the present invention may be employed in various and numerous embodiments without departing from the scope of the invention.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT(S)

Figure 1:
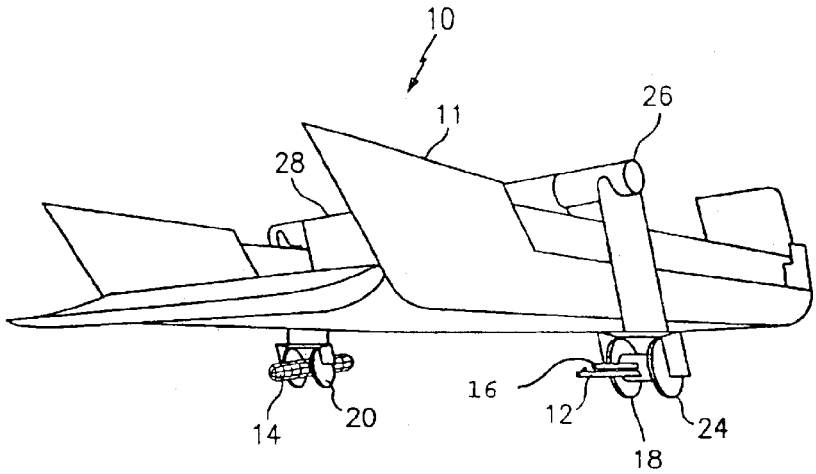
FIG. 1 illustrates a system for clearing mines and obstacles in accordance with the present invention.

Referring now to FIG. 1, the system 10 of the present invention generally comprises a vehicle 11 supporting a medium-caliber submersible gun 12 capable of firing super-cavitating undersea munitions (not shown) with the gun targeting by the use of an advanced active sonar system 14. The vehicle 11 may be a landing craft such as an LCU (landing craft utility), a remotely piloted, underwater, unmanned vehicle (UUV), a submersible AAAV(advanced amphibious assault vehicle) or any other known vehicle suitable for the operation of the gun 12 and the sonar system 14.

The complete system 10 includes the latest advancements in mine-hunting sonar, underwater gun technologies, super-cavitating underwater munitions, and amphibious/undersea capabilities to create a weapon capable of destroying underwater mines and other obstacles from waters of varying depths and to further include the surf-zone.

If the sonar targeting system 14 fails to function adequately, the system 10 includes other options to destroy mines and other obstacles such as optical sighting for targeting and saturation of a target area with projectiles where no targeting system is otherwise effective. Once ashore, the system 10 can support other landing operation functions such as beach mine clearance, obstacle removal, and light fire support.

In FIG. 1, the vehicle 11 is illustrated as a landing craft utility (LCU), which is a standard vehicle used in beach assault operations. The gun 12 of the vehicle 11 includes one or more barrels 16 depending on the requirements for targeting underwater munitions. The gun 12 is properly sealed to function underwater and, if required, includes sabot stripping and muzzle gas management systems. The pod 18, for mounting the gun 12, includes suitable means known in the art for allowing the pod 18 to be moved in multiple targeting directions.

Figure 2:
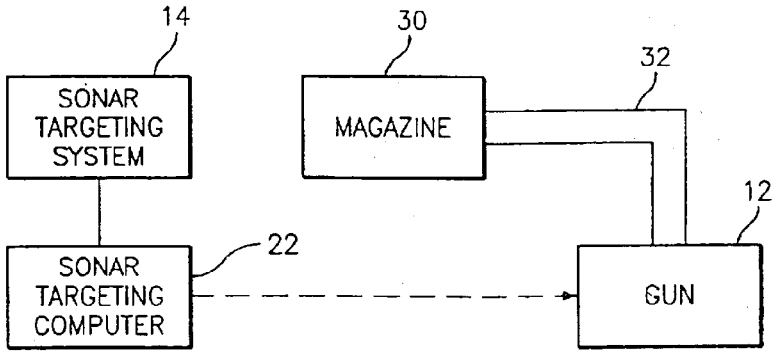
FIG. 2 is a schematic of the operation of the underwater gun of the system of the present invention.

The gun 12 is directed by readings taken from the underwater sonar targeting system 14 when activated. The sonar targeting system 14 is of the type of any suitable sonar targeting system known in the art and is mounted in a pod 20 which is similar to the pod 18 and movable in multiple targeting directions. During a clearing operation, the locations of mines detected by the sonar targeting system 14 are fed to an onboard targeting computer 22 (see FIG. 2) with the targeting computer used to properly direct the gun 12.

The vehicle 11 can be provided with an underwater stabilization system 24. The underwater stabilization system 24 comprises a two-component positioning system known in the art. The underwater stabilization system 24 allows the gun 12 and the sonar targeting system 14 to point in multiple targeting directions despite undulations of the vehicle 11.

Both the sonar targeting system 14 and the underwater gun are supported by one or more deployment arms 26. The deployment arms 26 allow the pods 18 and 20 to be rigidly held in the water. The deployment arms 26 are preferably large and rigid enough to prevent relative motion of the gun and sonar pods 18 and 20. If desired, the arms 26 can be fully retracted into the vehicle 11 to enable rapid transit and vehicle stowage. Any suitable means known in the art may be used to allow the arms 26 to move from a first position where the pods 18 and 20 are deployed to the fully retracted position.

The deployment arms 26 may be joined to at least one large structure 28 on the assault vehicle platform deck. Contained within the structure(s) 28 is powering equipment for the gun 12 and the deployment arms 26, as well as, a magazine 30 (see FIG. 2) for the gun 12. A feed system 32 is provided to carry munitions from the magazine 30, through the deployment arms 26 to the gun 12 in the pod 18. Each structure 28 can be rigidly mounted to the vehicle 11 or mounted to a wheeled vehicle (not shown) that can be deployed from the vehicle 11 to the beach.

In operation, the structure 28 of the system 10 is placed aboard the vehicle 11. The vehicle 11 then transits from the beach assault staging area to the mine field. The deployment arms 26 lower the pod 18 and the pod 20 into the water over the sides of the vehicle 11. The sonar targeting system 14 in the pod 20 scans using acoustic energy, the area in front of the vehicle 11 for underwater mines and other unwanted obstacles. When a mine or other target is detected, the pod 18 with the gun is pointed at the mine or target and a burst of mine piercing underwater projectiles is fired from the gun. The kinetic and explosive energy in the projectiles causes a mine or other target to explode. This is repeated as the vehicle 11 advances toward the beach.

In areas where the sonar targeting system 14 in the pod 20 cannot target mines, such as an area with breaking waves, a saturation technique is implemented, sending enough projectiles into the area from the gun 12 to significantly ensure that any mines or unwanted targets in the area would be impacted. Once at or near the beach, the pod 18 with the gun 12 and the pod 20 with the sonar targeting system 14 is moved from a deployed underwater position to a retracted position where the pod 18 and the pod 20 are located above the waterline such that the gun 12 is used to fire at on-shore targets. If the system 10 is attached to a wheeled vehicle, the vehicle can be driven onto the beach where it can continue to saturate areas where mines and other undesirable obstacles might be found.

The system 10 of the present invention produces rapid clearance of surf-zone mines. An advantage of the system 10 is that the system is much more rapid than existing surf-zone mine clearance systems and that it has multiple utilities (can be used for land strike once ashore).

The deployment arms 26 are either hard mounted to the vehicle 11 or attached to a wheeled vehicle that rolls on and rolls off the vehicle 11.

If required by an anticipated operation, the pods 18, 20 can be mounted to a single deployment arm 26.

If required by an anticipated military operation, the pods 18, 20 may be mounted to a dedicated surface or snorkeling vehicle such as an advanced amphibious assault vehicle or power boat.

It is apparent that there is provided in accordance with the present invention a surf zone mine clearance assault vehicle which fully satisfies the objects, means,.and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A system for removing mines and other obstacles in support of a vehicle capable of operating in varying depths of water, said system comprising:

a plurality of deployment arms mountable to the vehicle;

means for detecting the mines and the other obstacles, said detection means mountable to one of said deployment arms; and means for destroying the mines and the other obstacles, said destruction means mountable to another of said deployment arms wherein said deployment arms are capable of deploying said detection means and said destruction means into and from the water.

2. The system according to claim 1 wherein said destruction means comprises an underwater gun capable of targeting in a plurality of directions.

3. The system according to claim 2 wherein said detection means comprises a sonar targeting system.

4. The system according to claim 3 wherein said sonar targeting system is capable of targeting in a plurality of directions.

5. The system according to claim 4 further comprising a supporting base for said deployment arms, said supporting base mountable to a deck of the vehicle and capable of housing a magazine for said destruction means and capable of housing a feed system for carrying munitions from said magazine to said destruction means.

6. A system for removing mines and other obstacles in support of a vehicle capable of amphibious assault, said system comprising:

a plurality of deployment arms mountable to the vehicle;

means for detecting the mines and the other obstacles, said detection means mountable to one of said deployment arms; and means for destroying the mines and the other obstacles, said destruction means mountable to another of said deployment arms;

wherein said deployment arms are capable of deploying said detection means and said destruction means into and from water.

7. The system according to claim 6 wherein said destruction means comprises an underwater gun capable of targeting in a plurality of directions.

8. The system according to claim 7 wherein said detection means comprises a sonar targeting system.

9. The system according to claim 8 wherein said sonar targeting system is capable of targeting in a plurality of directions.

10. The system according to claim 9 further comprising a supporting base for said deployment arms, said supporting base mountable to a deck of the vehicle and capable of housing a magazine for said destruction means and capable of housing a feed system for carrying munitions from said magazine to said destruction means.

* * * * *